US007490831B2

(12) United States Patent
Simmons

(10) Patent No.: US 7,490,831 B2
(45) Date of Patent: Feb. 17, 2009

(54) THREE-DIMENSIONAL PUZZLE

(76) Inventor: Terry L. Simmons, 2500 Alder, #212, Milton, WA (US) 98354

( * ) Notice: Subject to any disclaimer, the term of this patent is extended or adjusted under 35 U.S.C. 154(b) by 138 days.

(21) Appl. No.: 11/099,127

(22) Filed: Apr. 4, 2005

(65) Prior Publication Data

US 2005/0194738 A1 Sep. 8, 2005

Related U.S. Application Data

(63) Continuation-in-part of application No. 10/268,199, filed on Oct. 9, 2002, now Pat. No. 7,021,625.

(60) Provisional application No. 60/363,741, filed on Mar. 12, 2002.

(51) Int. Cl.
*A63F 9/12* (2006.01)

(52) U.S. Cl. ..... 273/156; 273/157 R

(58) Field of Classification Search ..... 273/157 R, 273/153 R, 156, 153 S
See application file for complete search history.

(56) References Cited

U.S. PATENT DOCUMENTS

| | | | | | |
|---|---|---|---|---|---|
| 1,381,957 | A | | 6/1921 | Anderson | |
| 2,711,595 | A | * | 6/1955 | Sharp | 273/157 R |
| 2,957,251 | A | | 10/1960 | Nystad et al. | |
| 2,987,318 | A | | 6/1961 | Hammer | |
| 3,174,893 | A | * | 3/1965 | Church et al. | 273/157 R |
| 3,578,331 | A | | 5/1971 | DeGast | 273/157 R |
| 3,618,955 | A | | 11/1971 | Barnes | 273/157 R |
| 3,704,892 | A | | 12/1972 | Moravick et al. | 273/157 R |
| 3,851,884 | A | | 12/1974 | Myller | 273/157 R |
| 4,037,846 | A | | 7/1977 | Zeeman | 273/157 R |
| 4,050,184 | A | * | 9/1977 | Chiari | 273/157 R |
| 4,371,166 | A | | 2/1983 | Ferris et al. | 273/157 R |
| 4,474,377 | A | * | 10/1984 | Ashley | 273/153 S |
| 4,494,935 | A | | 1/1985 | Miller | 434/132 |
| 4,874,176 | A | | 10/1989 | Auerbach | 273/157 R |
| 5,114,148 | A | * | 5/1992 | Liu | 273/153 S |
| 5,165,689 | A | | 11/1992 | Forsse et al. | 273/157 R |
| 5,389,063 | A | * | 2/1995 | Wu | 273/153 S |
| 5,575,476 | A | * | 11/1996 | Yang | 273/153 S |
| 5,787,622 | A | * | 8/1998 | Green et al. | 273/157 R |
| 5,816,571 | A | * | 10/1998 | Chen | 273/153 S |
| 5,823,531 | A | | 10/1998 | Huber | 273/156 |
| 5,836,584 | A | * | 11/1998 | Chen | 273/153 S |
| 5,840,377 | A | | 11/1998 | Donnell | 428/33 |
| 5,842,697 | A | * | 12/1998 | Scott et al. | 273/157 R |
| 6,015,150 | A | | 1/2000 | Giguère | 273/157 R |
| 6,073,929 | A | | 6/2000 | Nahon | 273/156 |
| 6,398,221 | B1 | * | 6/2002 | Graham | 273/157 R |

(Continued)

FOREIGN PATENT DOCUMENTS

| | | |
|---|---|---|
| GB | 2 231 808 | 11/1990 |

*Primary Examiner*—Steven Wong
(74) *Attorney, Agent, or Firm*—Seed IP Law Group PLLC

(57) ABSTRACT

A three-dimensional puzzle of a familiar object, the puzzle including a puzzle substrate and a plurality of interlocking puzzle pieces that engage an outer surface of the substrate to form a representation of the familiar object. The edges of the puzzle pieces are beveled to reduce or eliminate binding between interlocked pieces as each piece is positioned in the puzzle. The puzzle may include a release mechanism for separating one or more of the puzzle pieces from the substrate.

21 Claims, 15 Drawing Sheets

U.S. PATENT DOCUMENTS 6,805,350 B1 * 10/2004 Wu ..... 273/157 R
7,021,625 B2 * 4/2006 Simmons ..... 273/157 R
2008/0061503 A1 * 3/2008 Giermek ..... 273/153 S

* cited by examiner

THREE-DIMENSIONAL PUZZLE

CROSS-REFERENCES TO RELATED APPLICATIONS

This application is a continuation-in-part of application Ser. No. 10/268,199 filed Oct. 9, 2002, which claims the benefit of U.S. Provisional Patent Application No. 60/363,741 filed Mar. 12, 2002. These prior applications are incorporated herein by reference in their entirety.

BACKGROUND OF THE INVENTION

The present invention relates to the field of puzzles, and more particularly to the field of three dimensional puzzles.

1. Field of the Invention

Many three-dimensional puzzles utilize pieces that interlock to form a structural or decorative shape. An example of this is found in U.S. Pat. No. 6,085,067, which describes interlocking planar elements united through male-female joints into predetermined three-dimensional configurations.

2. Description of the Related Art

Another form of puzzle utilizes a variety of connector elements for interconnecting the decorative and structural elements into a predetermined three-dimensional shape. U.S. Pat. No. 6,015,150 illustrates this form of puzzle as being a kit of parts that includes of generally flat structural and decorative components for forming a three-dimensional puzzle.

U.S. Pat. No. 2,987,318 describes a three-dimensional puzzle having a base form for receiving projecting pegs on puzzle pieces forming a predetermined shape. The pieces are configured to interlock with each other and with a central portion. These puzzles require assembly in a predetermined order and do not complement the same detail, shape, dimensions, feel and appearance of an existing object.

A disadvantage of previous designs is the complexity and resulting high cost of design and manufacture. In addition, previous three-dimensional puzzles do not have the same exterior detail, shape, dimensions, feel, and appearance of the original object.

BRIEF SUMMARY OF THE INVENTION

An embodiment of the invention provides a three-dimensional puzzle having a substrate and a plurality of rigid, non-planar interlocking pieces, each having a substantially uniform thickness and configured to be coupled to an outer surface of the substrate, forming, thereby, the likeness of a familiar object. The familiar object may be a beverage container such as a soda can, a bottle, or a coffee mug. Other objects include a piece of fruit, a baseball, candy bars, a model car, and models of popular landmarks. The puzzle may include a release mechanism for separating the puzzle pieces from the substrate.

Another embodiment of the invention provides a beverage container, including a cavity configured to receive a beverage therein.

According to an embodiment of the invention, each of the interlocking pieces includes a feature configured to engage a corresponding feature of another puzzle piece when correctly co-positioned therewith. The edges of the puzzle pieces are beveled, or otherwise relieved such that, when two pieces are correctly co-positioned with each other, the pieces make contact along a contiguous border at their upper surfaces without making contact at their lower surfaces.

BRIEF DESCRIPTION OF THE SEVERAL VIEWS OF THE DRAWINGS

The foregoing and other features and advantages of the present invention will be more readily appreciated as the same become better understood from the following detailed description when taken in conjunction with the accompanying drawings, wherein like elements are referred to with like reference numbers.

DETAILED DESCRIPTION OF THE INVENTION

Figure 1:
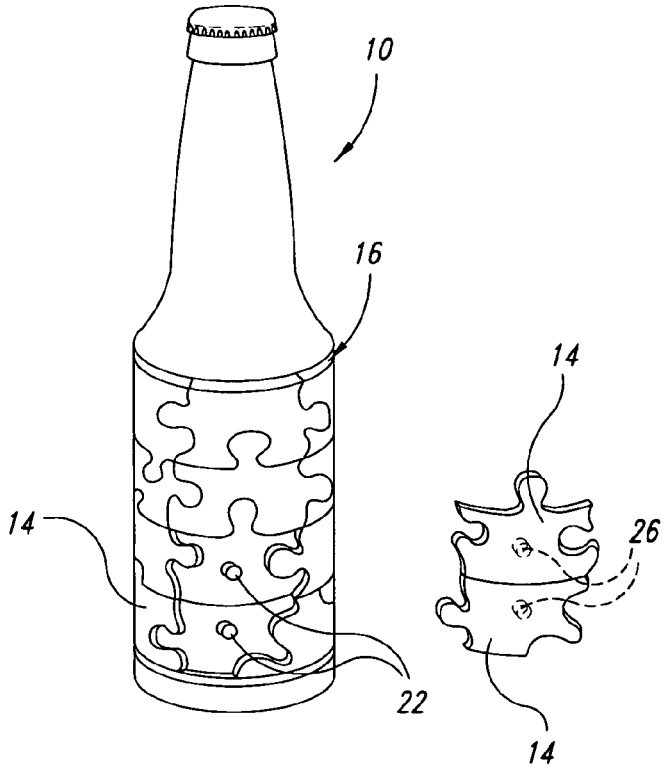
FIG. 1 is a side plan view of a beverage bottle puzzle having mid-section puzzle pieces in partially-disassembled configuration illustrating the general concept of the present invention.
Figure 2A:
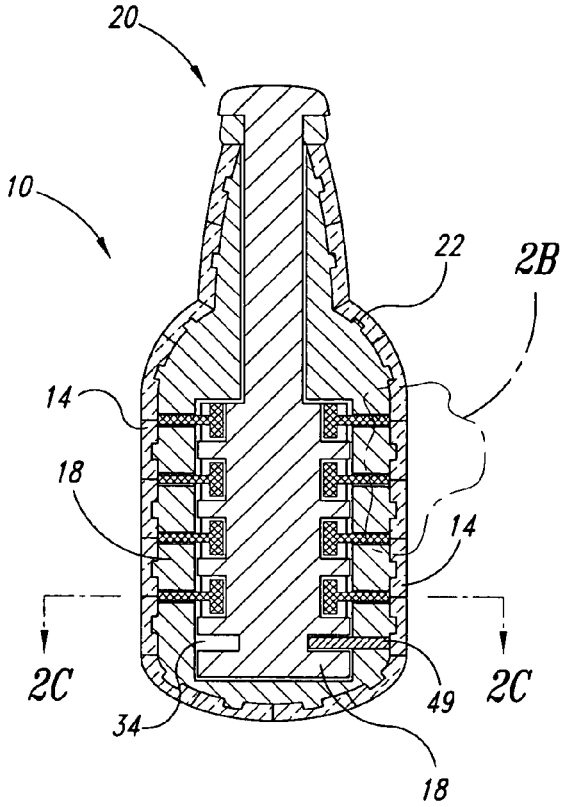
FIGS. 2A-2C are a partial cross-sectional side view and two enlarged sections, respectively, of the bottle puzzle of FIG. 1.

A first embodiment of the invention is described with reference to FIGS. 1-3. Referring initially to FIG. 1, shown therein is a beverage bottle puzzle 10. A plurality of puzzle pieces 14 are shown attached to a mid-section 16 of the bottle 10. Several of these pieces 14 are shown removed.

Referring next to FIGS. 2A-2C, and FIG. 3, the bottle puzzle 10 is shown in assembled and disassembled form, respectively, and includes the puzzle pieces 14 assembled to a structural support or substrate 18 that has a release component 20 rotatably mounted therein. According to an embodiment of the invention, the structural assembly 18 is substantially a scale model of the original object with provisions for retention and release devices or components.

Figure 2B:
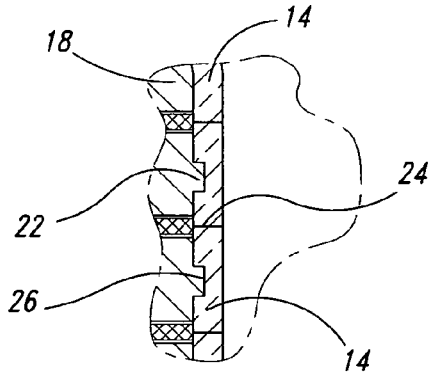

FIG. 2B shows in detail the puzzle pieces 14 snapped in place onto protrusions 22 that are formed on an exterior surface 24 of the structural support 18. Ideally, the puzzle pieces 14 lock to each other using conventional jigsaw puzzle techniques. Each piece 14 also includes an impression 26 formed on a back surface 28 thereof that is sized and shaped to slideably receive the protrusion 22 with a tight fit. The back surfaces 28 of pieces 14 are also shaped to make contact with the corresponding exterior surface of the substrate 18.

Figure 2C:
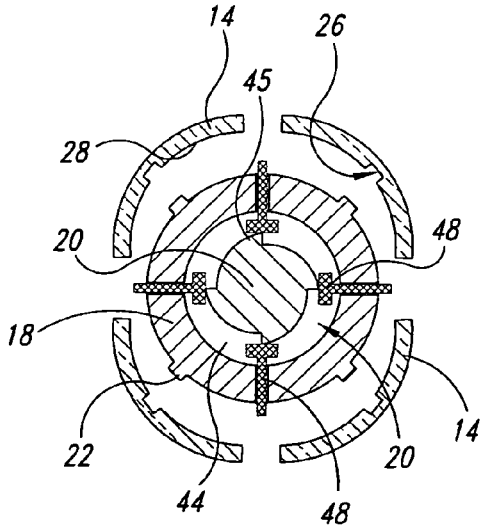

FIG. 2C shows in detail how the release pins 48 interact with the puzzle pieces 14 to force them away from the adjacent pieces and off the protrusion 22 when release component 20 is rotated and the depth of lateral grooves 44 diminishes as the cam lobe 45 rotates under the release pins.

Figure 3A:
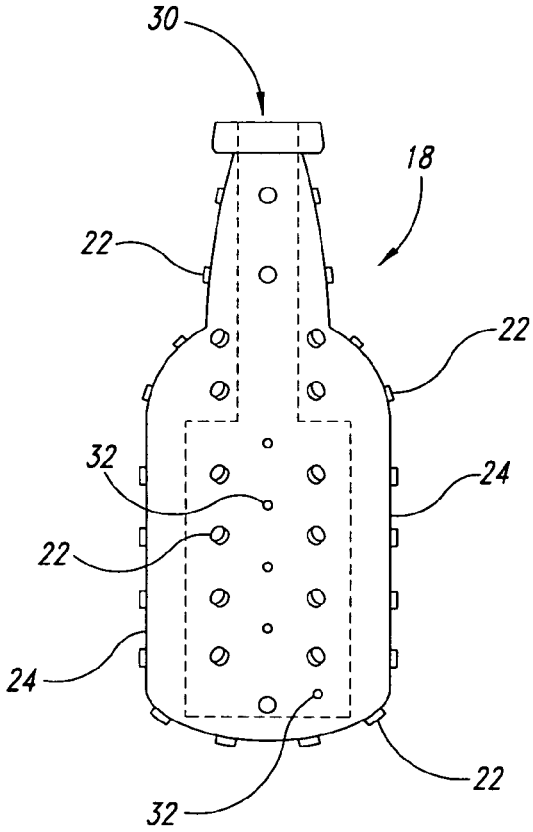
FIGS. 3A and 3B are side views of the support structure and the release mechanism of the bottle puzzle of Figure, respectively 1.
Figure 3B:
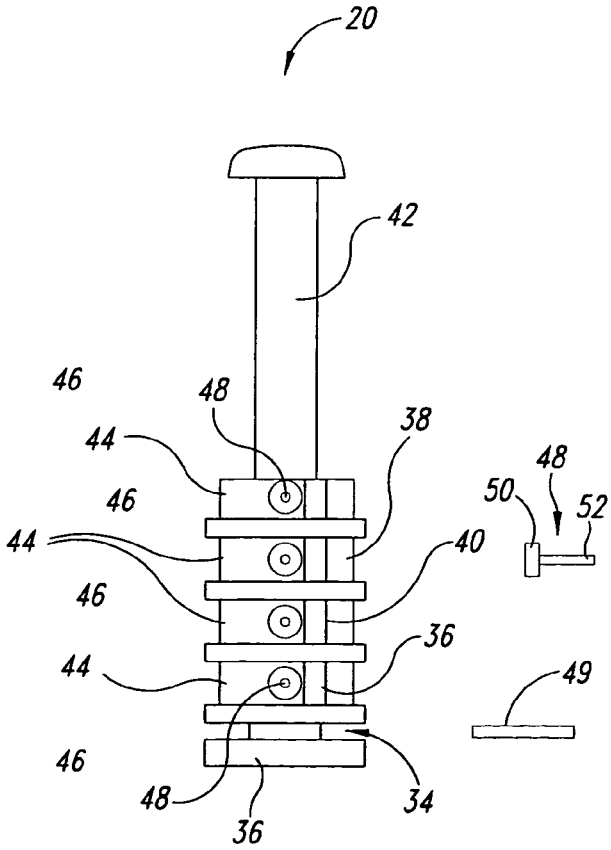

Shown disassembled in FIGS. 3A and 3B are the structural support 18 and the release component 20. The structural support 18 has a plurality of the protrusions 22 formed on portions of the exterior surface 24 of the structural support 18 where the puzzle pieces 14 are to be positioned. This structural support 18 includes a hollow interior 30 that is sized and shaped to hold the release component 20. Openings 32 are formed in the structural support 18 that communicate with the interior 30 thereof.

The release component 20 is formed to have a cylindrical shape with a retaining groove 34 circumscribing a lower portion 36. A longitudinal groove 38 is formed on the surface 40 of the lower portion 36 to extend from the lower portion 36 to a reduced circumference portion 42. Extending laterally from the longitudinal groove 38 are four lateral grooves 44 having a depth that diminishes from the longitudinal groove to a lateral end section 46 forming, as illustrated cross sectionally in FIG. 2C, a series of cams, having at least one lobe 45. Alternatively, the release component 20 may be formed such that the entire length of the lower portion 36 has a cross section similar to that shown in FIG. 2C, without intervening lateral grooves or other features. A pin 48 having a head end 50 of substantially greater diameter than a body portion 52 is inserted into each lateral groove 44, which lateral grooves 44 are sized to receive the head end 50 of the pin 48. When assembled, the release component 20 is rotatably mounted in the interior 30 of the structural support 18 with the pins 48 mounted therein so that the body portion 52 projects into the corresponding opening 32. A retention pin 49 holds the release component 20 in place inside the structural support 18. As shown in FIG. 2C, rotation of the release component 20 in the appropriate direction, in this case counterclockwise, causes the pins 48 to project through the openings 32 and urge the puzzle pieces 14 to disconnect from the protrusions 22 and to release engagement with adjacent puzzle pieces 14.

According to one embodiment of the invention, a method of manufacture of the puzzle described with reference to FIGS. 1-3 is as follows: a mold of the object is formed to conform to the contour and detail of the original object or model in every detail except for an area designated for assembly. Such mold may be designed to cast only a thin layer of the exterior of the object or a solid casting.

Following formation of the mold, liquid plastic is then poured into the interior of the mold and allowed to cure. When the casting is solid, it is hollowed out to leave only a thin layer of the exterior of the object. The thin layer from either casting method described above is then cut into individual jigsaw-type puzzle pieces 14. The individual jigsaw puzzle pieces 14 are drilled to form the impression 26. The puzzle pieces 14 are then assembled into a jigsaw portion that resembles the original object.

The structural support 18 is then cast inside the assembled jigsaw pieces using conventional casting techniques. When the casting of the structural support 18 is cured, the individual puzzle pieces 14 are removed.

The release component 20 is then cast inside the structural support 18, which has previously been hollowed out. When the casting of the release component 20 is cured, a top portion of the release component 20 is cut off to enable separation of the release component 20 from the structural support 18.

The openings 32 for the release pins 48 and a retention pin 49 are formed, such as by drilling, in the structural support 18. The retaining groove 34, longitudinal groove 38, and the plurality of lateral grooves 44 are then machined into the surface of the release component 20 to match the location of the openings 32 in the structural support 18. The longitudinal groove 38 is preferably machined to a depth that allows for passage of the release pins 48 on assembly of the release component 20; and the lateral grooves 44 are machined from the depth of the longitudinal groove 38, at the start of the machining process, to a point where the lateral grooves 44 are diminished to meet the surface of the release component 20. The retaining groove 34 is machined to a uniform depth in the surface of the release component 20 to enable rotation of the release component 20 with the retention pin 49 in place.

The release pins 48 are inserted into the openings 32 in the structural support 18, and the release component 20 is assembled into the structural support 18. The top portion of the release component 20 is reattached and the retention pin 49 is inserted through an opening 33 in the structural support 18.

The individual puzzle pieces 14 are then attached to the structural support 18 by aligning them with adjacent puzzle pieces 14 and with the impression 26 aligned with a corresponding protrusion 22. Sufficient pressure is applied to snap the puzzle pieces 14 into position on the structural support 18.

The puzzle 10 is now complete and matches the contour and detail of the original object or model. As such, it is ready for labeling and packaging.

To disengage the puzzle pieces 14 from the structural support 18, the release component 20 is turned counterclockwise until the bottom surface of the machined lateral grooves 44 in the release component 20 make contact with and push the release pins 48 outward through the openings 32 in the structural support 18, thereby forcing the individual puzzle pieces 14 to release from the protrusions 22, as illustrated in FIG. 2C.

Reassembly requires that the release component 20 be rotated clockwise to a position where the release pins 48 are allowed to recess into the corresponding lateral grooves 44 in the structural component 20. The individual puzzle pieces 14 can then be reattached.

The method described above is one possible method of manufacture. Other acceptable methods include injection molding of each piece of the puzzle individually, or molding of the structural support separately from the pieces. Further alternative methods may be employed without departing from the scope of the invention.

Figure 4A:
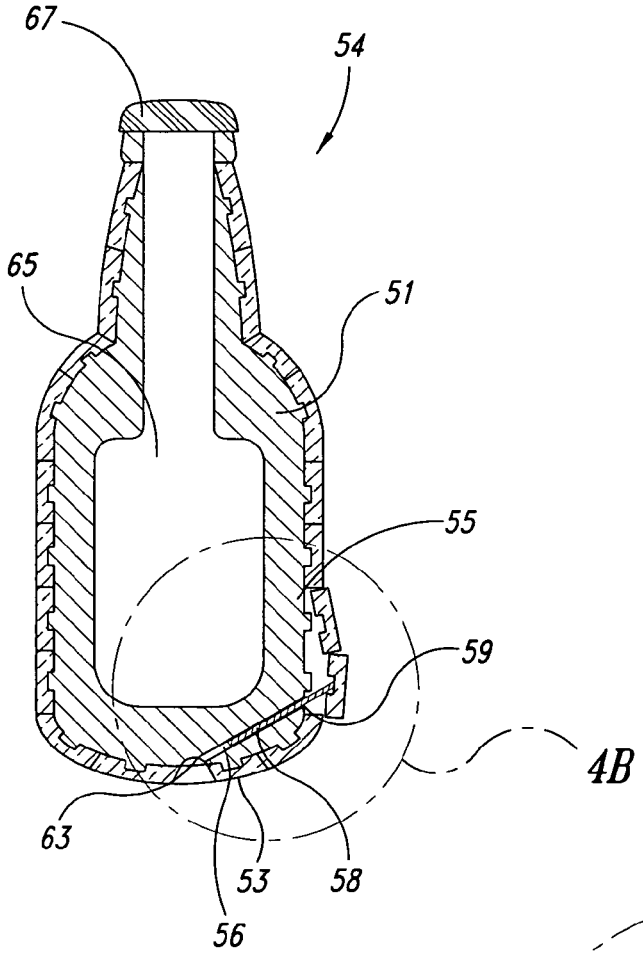
FIGS. 4A and 4B are partial sectional views of an alternative embodiment of a bottle puzzle and a detail of the release mechanism, respectively.
Figure 4B:
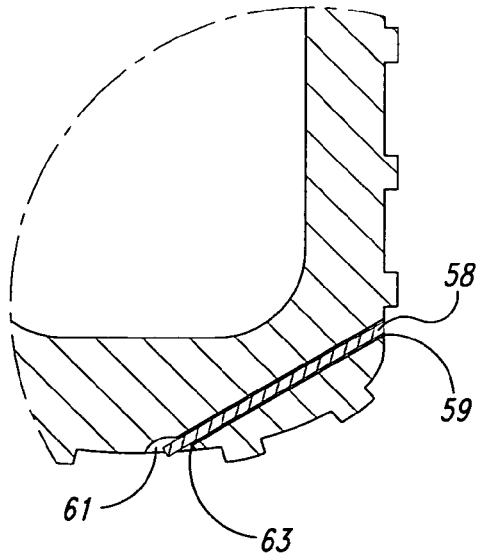

An alternative release mechanism is illustrated in FIGS. 4A and 4B. Shown therein is a puzzle 54 in the shape of a beverage bottle, similar to the puzzle 10 illustrated in FIGS. 1-3. An aperture 56 is provided, passing from one surface of the puzzle 54 to another. In the illustrated embodiment, the aperture 56 passes from a bottom surface 53 to a side surface 55 of the support structure 51. The aperture emerges on the side 55 in a position that corresponds to the position of one of the puzzle pieces 14 when the puzzle 54 is assembled. A release rod 58 passes through the aperture 56 from an end that protrudes slightly from the bottom 53 of the puzzle to terminate substantially flush with the side 55 of the puzzle 54. When the puzzle 54 is assembled, a puzzle piece 14 covers the side opening 59 of the aperture 56. By pressing against a protruding portion of the release rod 58, the rod 58 is caused to extend from the aperture 56 on the side 55 to cause the piece 14 covering the opening 59 to detach from the puzzle 54. In this way, a first piece 14 of the puzzle 54 may be removed. Additional pieces 14 surrounding the position of the first piece 14 may now be pried from the support structure 51 with a finger, continuing in this fashion until all the puzzle pieces 14 are removed. A depression 61 may be formed around the opening 63 of the aperture 56 at the bottom 53 of the support structure 51, which allows the release rod 58 to protrude from the opening 63 in the depression 61 while still remaining approximately flush with the bottom surface of the puzzle 54.

Also illustrated in FIG. 4 is a cavity 65 formed in the puzzle 54 suitable for containing a liquid. In this embodiment of the invention, a beverage may be placed in the cavity 65 and the cavity 65 closed using a standard bottle cap 67. The puzzle 54 may be configured to receive either a screw-off type or pop-off type bottle cap. This embodiment may be exploited by a soft drink bottler or beer bottler, for example, to conduct a sales campaign in which puzzles according to an embodiment of the invention are provided as promotional tools. The puzzles are marked with the livery of the bottler and contain a portion of the product being touted.

Figure 5:
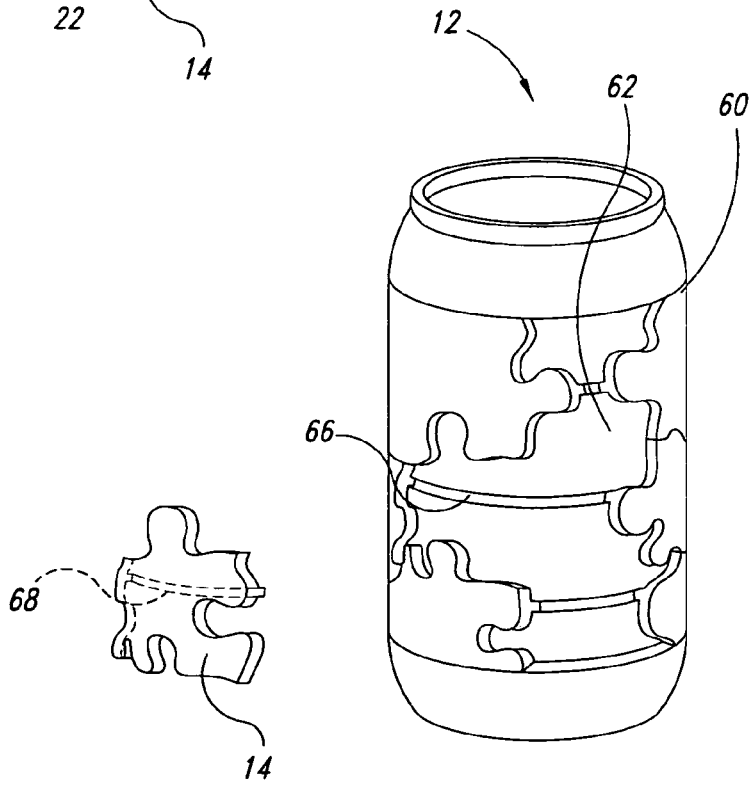
FIG. 5 illustrates an embodiment of the invention in the shape of a soda can.

It will be recognized that, while the embodiments of the invention described with reference to FIGS. 1-4 are shown in the shape of a bottle, the object represented by a puzzle according to the invention may be any of a large variety of objects. For example, FIG. 5 illustrates an embodiment in which the puzzle is in the form of a can 12 of the type commonly used for soft drinks. A recessed region 60 is provided around a midsection of the puzzle 12, into which the puzzle pieces 14 are assembled. The thickness of the individual pieces 14 is substantially equal to the depth of the recessed region 60. Thus, when the puzzle 12 is completely assembled, the result is a dimensionally accurate representation of a soda can.

FIG. 5 illustrates an embodiment of the invention in which the puzzle 12 is in the shape of a soda can. A recessed region 60 is formed around a perimeter of the puzzle 12 and the puzzle pieces 14, when assembled onto the substrate 62, fit into the recessed region. An alternative means for coupling the puzzle pieces to the substrate is illustrated in FIG. 5 as described in more detail with reference to FIG. 6.

Figure 6:
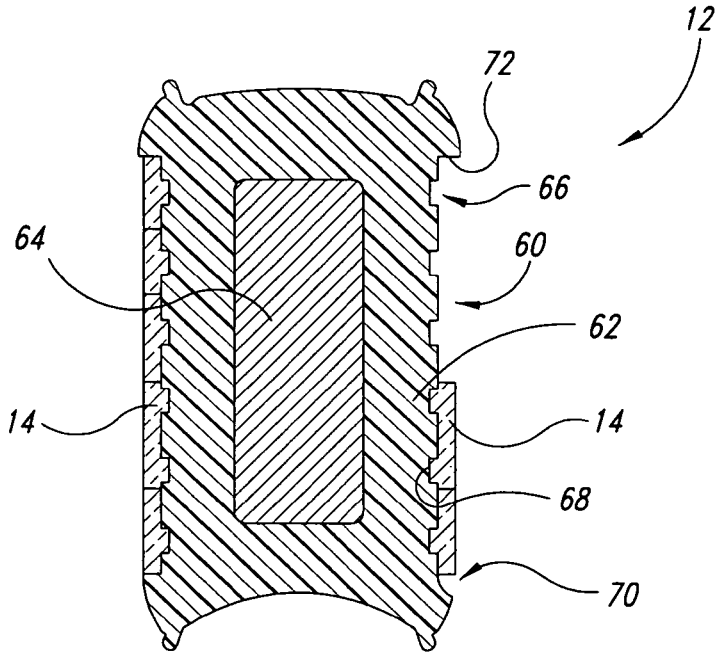
FIG. 6 is a sectional view of the embodiment of FIG. 5.

FIG. 6 is a cross section of the puzzle 12 where the body 62 of the puzzle 12 is shown as a substrate in which the recessed region 60 is formed and on which a plurality of puzzle pieces 14 are supported. In the illustrated embodiment, a weight 64 is provided to give to the puzzle 12 a weight and balance approximately equal to that of a filled soda can. Each of the puzzle pieces 14 is provided with means for coupling the pieces 14 to the body 62. In this embodiment, the recessed region 60 includes a series of grooves or ridges 66 circumscribing the body 62 and spaced at regular intervals. Features 68 formed on a backside of each of the pieces 14 are configured to snugly engage the grooves to hold the pieces 14 in place. A thumb notch 70 is provided in a portion of the sidewall 72 of the recess 60 to permit removal of one of the pieces 14. With a first piece removed, a succeeding piece of the plurality of pieces 14 may then be removed in a similar fashion. Alternatively, one of the pieces 14 may have a gap provided, into which a finger may be inserted to pull a first piece 14 away from the body 62.

According to one embodiment of the invention, the body is manufactured in a manner similar to the embodiments described with reference to FIGS. 1-4. In another embodiment, the body 62 is formed of aluminum and is manufactured using methods commonly used by manufacturers of soft drink cans. The body 62 is formed as a soft drink container and has the recessed region 60 and ridges 66 formed as features of the aluminum can. The puzzle pieces 14 are manufactured separately and configured to engage the ridges 66 formed in the sides of the aluminum body, and they are marked with the trade dress of a soft drink manufacturer. In this way, when the puzzle is fully assembled, it resembles and functions as a standard beverage container sold by the respective manufacturer, and it also functions as a three-dimensional puzzle according to an embodiment of the invention.

Various embodiments of the invention are described with reference to FIGS. 7-12.

Figure 7:
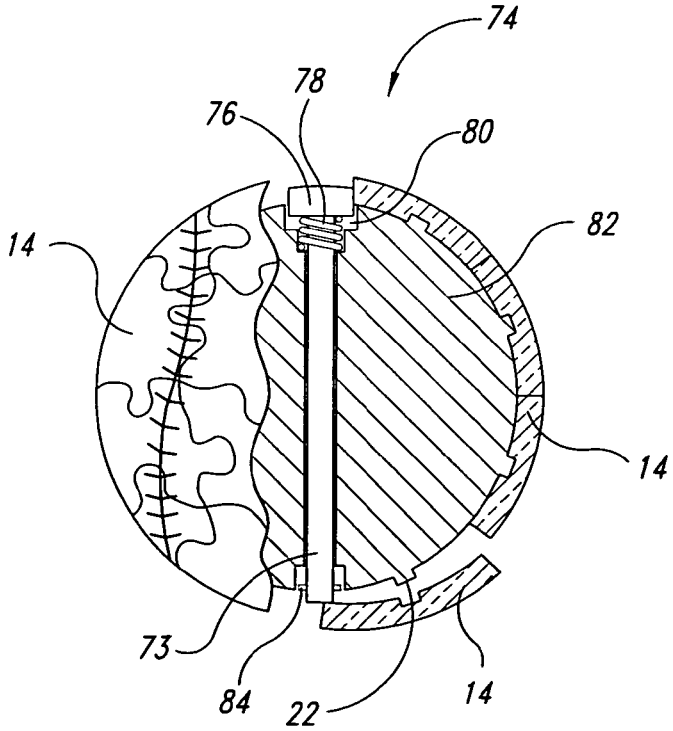
FIG. 7 is a side view of a partially disassemble baseball formed in accordance with another embodiment of the invention.

FIG. 7 shows a sectional view of a three-dimensional jigsaw puzzle 74 made according to an embodiment of the invention and having the dimensions, texture, and markings of a major league baseball. This embodiment may be manufactured utilizing the same manufacturing methods described previously. The baseball puzzle utilizes a single spring-loaded release pin 73 attached to one of the baseball jigsaw puzzle pieces 76. Finger or other pressure pushing on the puzzle piece compresses the spring 78, allowing the puzzle piece to move into a recessed area 80 in the structural assembly 82. This forces one or more jigsaw puzzle pieces 14 off their structural protrusions 22 and away from the adjacent jigsaw puzzle pieces 14, allowing easy removal of the remaining puzzle pieces 14. The spring 78 forces the release pin 73 back into its neutral position when pressure is released. The release pin 73 utilizes a detente pin 84 as a stop on the end opposite the spring 78 to prevent the release pin 73 from coming fully out of the structural assembly 82. As in other embodiments, the baseball puzzle 74 may be internally weighted to closely approximate the weight and balance of the object from which it is patterned, resulting, in this embodiment, in an object that may be mistaken for an actual major league baseball, complete with coloring and marking, stitching, surface texture, and weight of the genuine article.

Figure 8A:
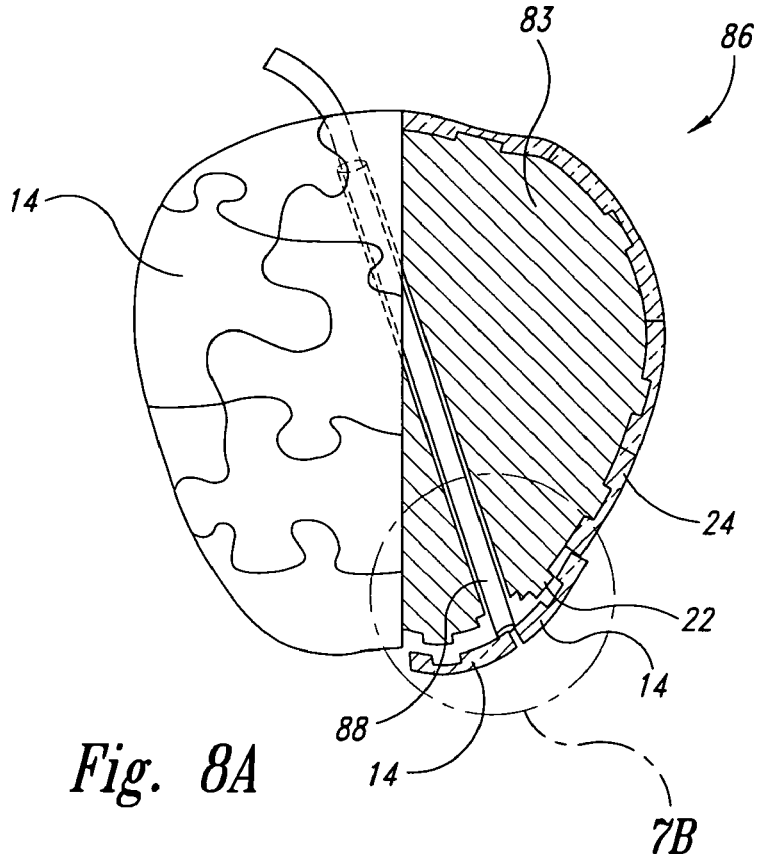
FIG. 8A is a side view of a partially disassembled apple puzzle formed in accordance with another embodiment of the invention.
Figure 8B:
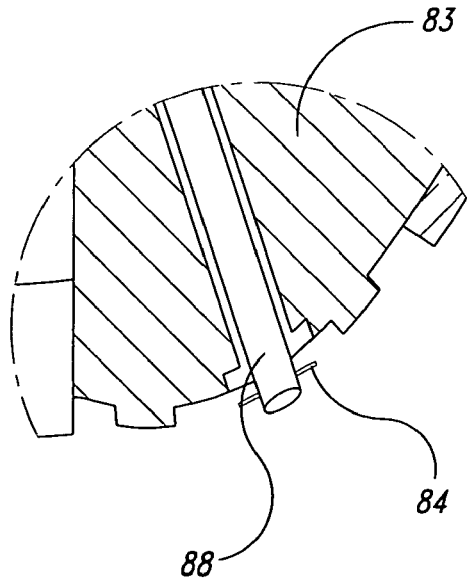
FIG. 8B is an enlarged sectional view of the pushpin stop assembly of the apple puzzle of FIG. 8A.

FIG. 8A shows a sectional view of a three-dimensional jigsaw puzzle 86 made according to an embodiment of the invention in the shape of an apple. This apple puzzle 86 utilizes a single release pin 88 having the appearance of an apple stem. Pushing downward on the stem 88 forces one or more jigsaw puzzle pieces 14 off their structural protrusions 22 and away from the adjacent puzzle pieces 14, allowing easy removal of the remaining puzzle pieces 14. The release pin 88 moves smoothly into a neutral position having the characteristics of a typical apple stem when the puzzle piece 14 is replaced. This release pin utilizes a detente pin 84 as a stop to prevent the release pin 88 from coming fully out of the structural assembly 83, as illustrated in FIG. 8B.

Figure 9A:
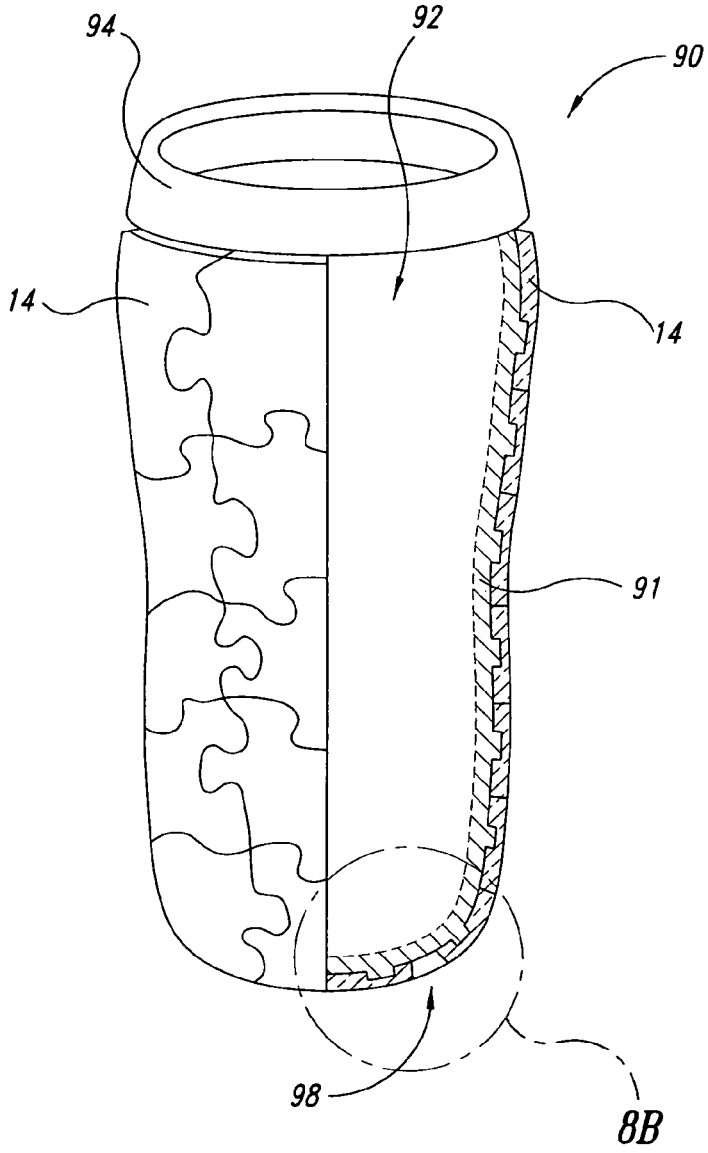
FIG. 9A is a side view of a partially disassemble coffee mug puzzle formed in accordance with another embodiment of the invention.

FIG. 9 shows a sectional view of a three-dimensional jigsaw puzzle 90 made according to an embodiment of the invention in the shape of a coffee mug. This coffee mug puzzle 90 has a hollow interior 92 and screw on cap 94 and can be used as a regular coffee mug. The puzzle 90 may have puzzle pieces 14 covering a central region only, in a manner similar to that illustrated in FIGS. 5 and 6, or the puzzle 90 may include pieces covering the entire outer surface of the substrate 91, as illustrated in FIG. 9A.

Figure 9B:
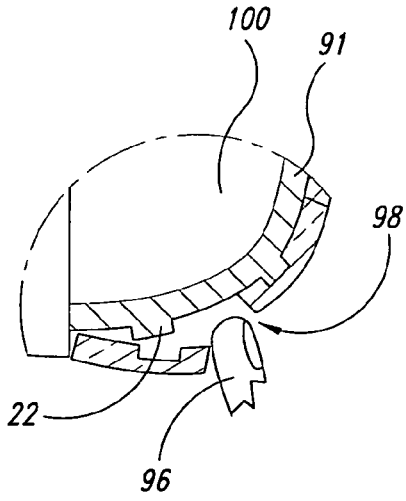
FIG. 9B is an enlarged sectional view of the preferred release method of the coffee mug puzzle of FIG. 9A.

The coffee mug puzzle 90 is disassembled, as illustrated in FIG. 9B, by inserting a finger tip 96 into a recessed area 98 in the base 100 of the puzzle 90 and pushing outward to force one or more pieces 14 off their structural protrusions 22 and away from the adjacent jigsaw puzzle pieces 14, allowing easy removal of the remaining puzzle pieces 14. These coffee mug puzzles 90 may include features, such as handles, to enhance the usability of the puzzle 90 as a regular coffee mug without departing from the spirit and scope of this invention.

Figure 10:
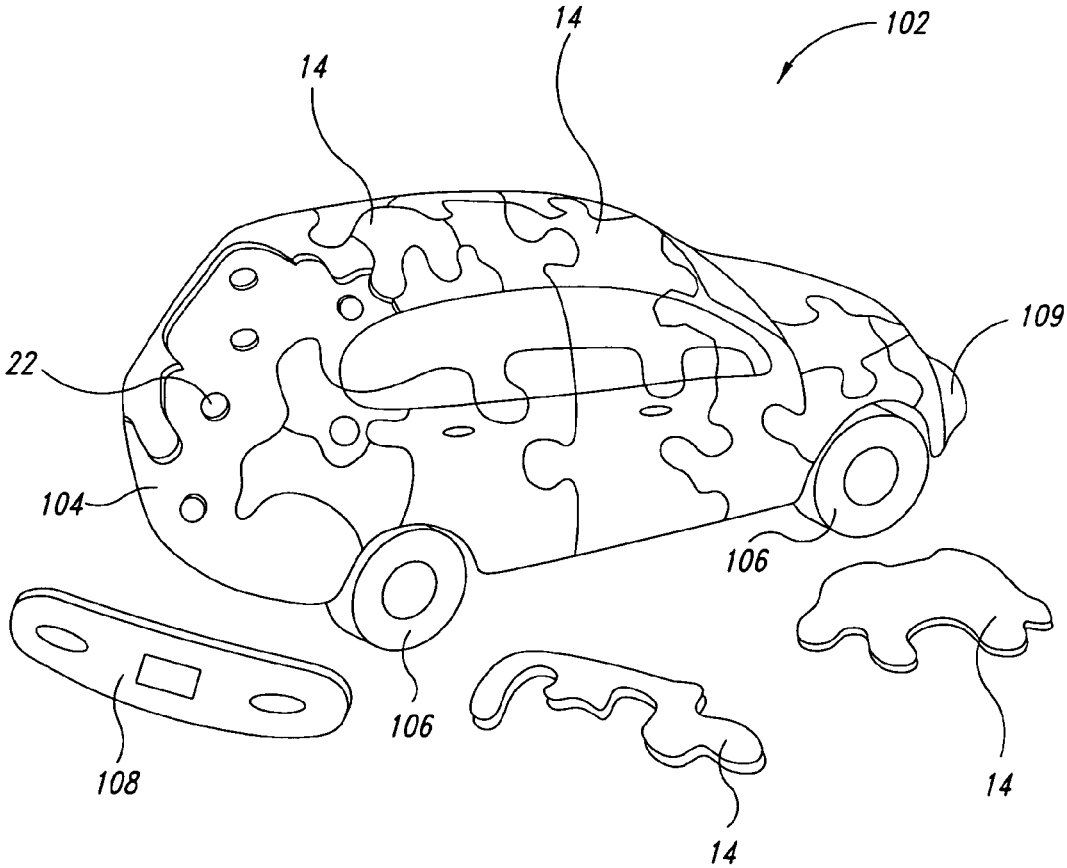
FIG. 10 is a side view of a partially disassemble model car puzzle formed in accordance with another embodiment of the invention.

FIG. 10 illustrates a partially disassembled three-dimensional jigsaw puzzle 102 made in the shape of a scale model of a popular car and having a structure 104 that is designed to accommodate add on pieces, such as wheels 106, bumpers 108, 109 and other pieces, to enhance the likeness of the original vehicle. This puzzle 102 can be disassemble by removing the rear bumper 108 and using the tip of a finger or other means to force the pieces 14 away from the structural protrusions 22 and the adjacent puzzle pieces.

The puzzle pieces described with reference to many of the embodiments have an overall thickness that may be referred to as the mode thickness. The term "mode thickness" is defined as the predominant thickness of a puzzle piece. For example, referring to FIG. 2B, each piece 14 includes one or more depressions, or cavities, 26 configured to receive corresponding protrusions 22. It might be said, then, that each piece has a predominant, or mode, thickness between a front face and a back face over most of the area of the piece, and a second thickness only at the location of the depression 26.

Referring to FIG. 5, the embodiment is pictured as having pieces 14 with features 68 extending from the back surface of each piece 14, configured to engage grooves 66 formed in the substrate 62. Again, the mode thickness is the thickness of the piece 14 between the front and back faces over most of the area of the piece, excepting the area corresponding to the position of the feature 68.

According to various embodiments of the invention, features of the puzzle pieces slideably engage corresponding features of the puzzle substrate. It may be said that the puzzle pieces and the substrate interpenetrate to some degree. The actual depth of interpenetration is limited by the dimensions of the coupling features, such as protrusions or depressions. referring to FIGS. 2B and 5, it may be seen that, in the embodiments pictured, the depth of interpenetration is less than the mode thickness of the respective puzzle pieces.

As may be seen in various illustrated embodiments, the features employed to couple puzzle pieces and substrates may be formed integrally with the corresponding component. For example, referring to FIG. 6, it may be seen that the puzzle pieces 14 and the respective features 68 may be unitary in formation, which is to say that they may be formed as a single unit, whether by injection molding, machining, or some other method.

Another example may be seen in the embodiment described with reference to FIGS. 9A and 9B, in which the protrusions 22 may be integral with the substrate 91, rather than attached thereto.

Figure 11A:
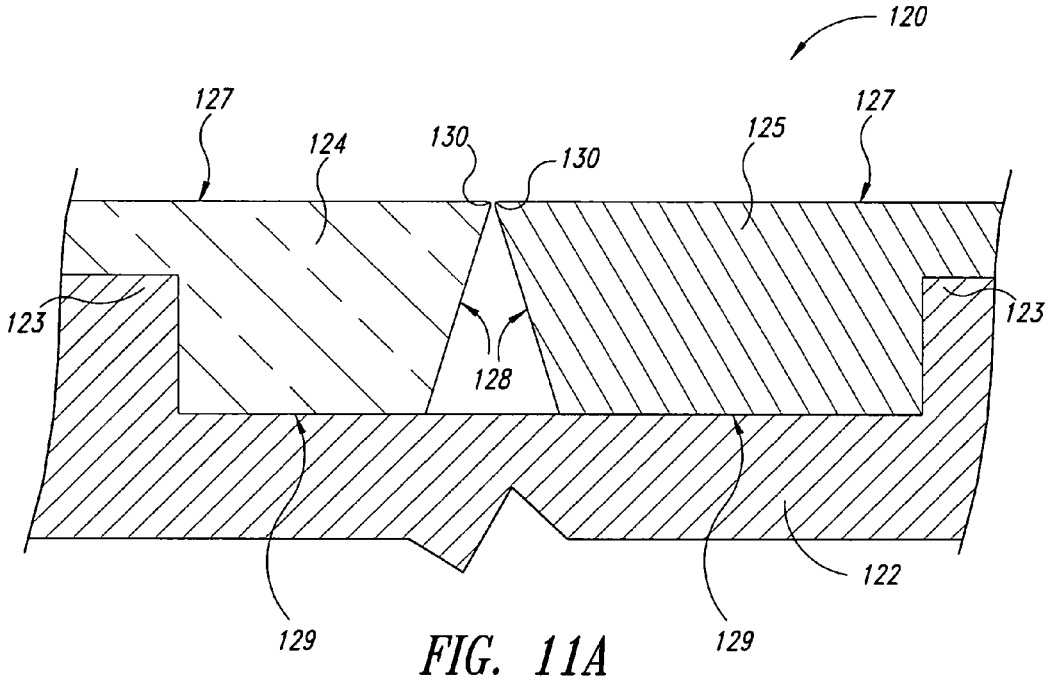
FIGS. 11A and 11B are sectional views of puzzle pieces coupled to a substrate, according to an embodiment of the invention.

Referring now to FIGS. 11A-13, features of the puzzle pieces will be described, according to an embodiment of the invention. FIG. 11A shows a portion of a puzzle 120 in cross section. The puzzle 120 includes a substrate 122 having protrusions 123 and puzzle pieces 124, 125 having corresponding depressions 126 configured to slideably engage the respective protrusions 123. The puzzle pieces include upper and lower faces 127, 129, respectively and side walls 128 that, in plan view, define the shape of the respective piece. The side walls 128 of the puzzle pieces 124, 125 diverge starting from the upper face 127 and ending at the lower face 127 of the respective opposing piece 125, 124. In other words, the side walls 128 angle inward from upper edges 130 of the pieces 124, 125, as shown. The side walls 128 may be positioned or beveled such that a sharp corner is formed at the upper edges 130, or they may terminate in rounded over or bull-nosed edges. Alternatively, an upper portion of the side walls 128 may be substantially vertical, with a beveled portion beginning some distance below the upper faces 127 of the pieces 124, 125.

Interlocking puzzle pieces are generally manufactured with some degree of tolerance, such that, when assembled, there may be some space between the pieces. Accordingly, the upper faces of the puzzle pieces may not make continuous contact along their adjacent edges. Additionally, referring to the bull-nosed edges described above with reference to FIG. 11A, it will be recognized that the pieces 124 and 125 actually may contact each other, if at all, some small distance below the plane defined by their upper faces 127, depending on the radius of the bull nose. Nevertheless, for the purpose of defining features of the present invention, it may be generally stated that when correctly assembled the pieces 124, 125 make contact along their contiguous border at their upper faces 127 without making contact at their lower faces 129. Likewise, where the claims recite terms such as "contact" or "make contact," etc., such terms are to be read broadly so as to read on puzzle pieces configured as described above with reference to the upper faces 127 of pieces 124, 125, even when there is little or no actual contact. This is in contrast to puzzle pieces with faces that, by design, are configured to make no contact, such as, for example, the lower faces 129 of pieces 124, 125 described above.

Figure 11B:
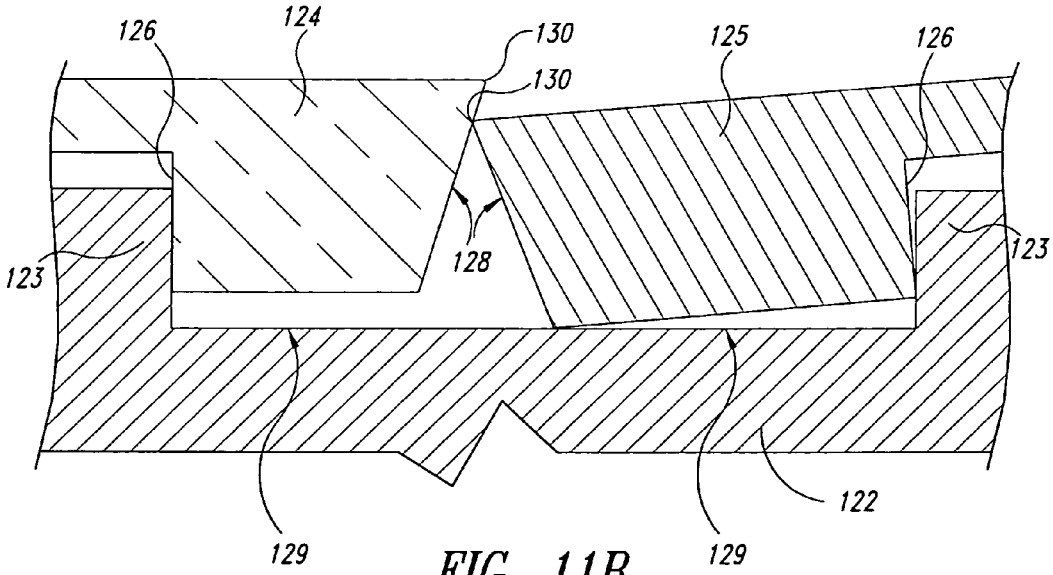

Puzzle pieces having these beveled side walls afford several advantages, especially in the case of three-dimensional puzzles such as those disclosed and claimed herein. FIG. 11B shows the portion of the puzzle 120 in which the puzzle piece 125 has been angled upward on the right side, as when a user is in the process of disassembling the puzzle 120. As may be seen, when the piece 125 angles upward, the edge 130 thereof drops below the edge 130 of the neighboring piece 124. As the angle of the piece 125 increases, the edge 130 slides down the beveled face 128 of the piece 124 while simultaneously exerting steadily increasing lateral pressure to the left. Lateral movement of the piece 124 is prevented by its engagement with the protrusion 122, and so the piece 124 rises slightly to accommodate the piece 125. Thus, during disassembly, removing one puzzle piece from the substrate 122 tends to loosen the next piece for easier removal.

The amount of lateral pressure imparted is controlled by factors such as the overall size of the puzzle pieces, the angle of the bevel, the space between the pieces, the radius of the bull-nosed edge, etc. Additionally, the lateral pressure may be substantially reduced by forming the puzzle pieces of a material having a degree of resiliency or deformability, such as may be found in many common plastics used in the industry.

According to an alternate embodiment of the invention (not shown), the side walls 128 of the puzzle pieces can have shapes other than a bevel, such as a curve or steps, to effect a separation between the lower faces of adjacent pieces while contacting along the upper faces thereof.

Figure 12:
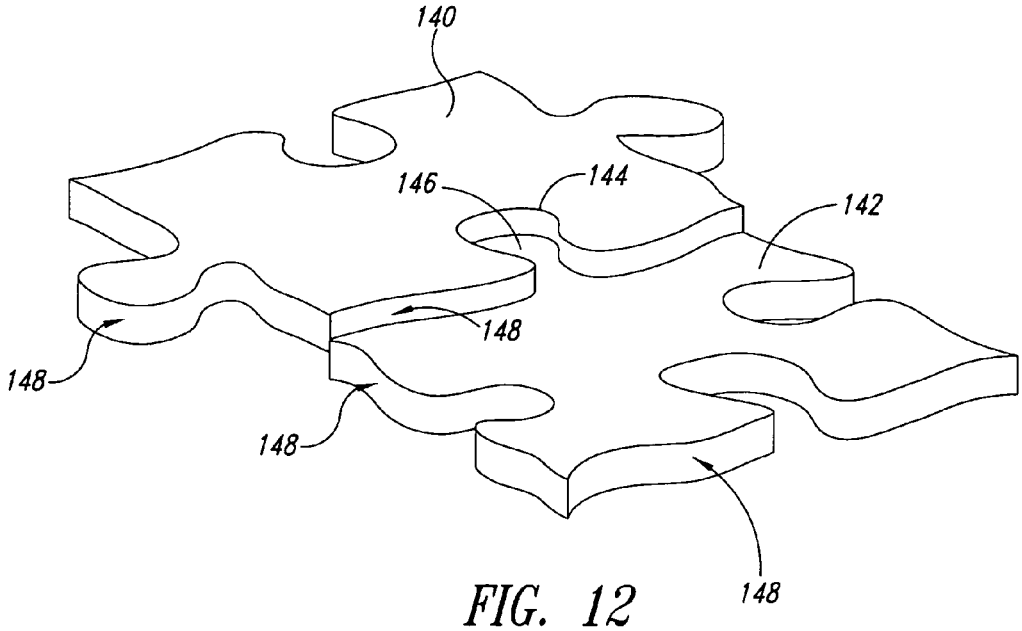
FIG. 12 (Prior Art)
FIG. 12 shows two interlocking puzzle pieces according to known art.

FIG. 12 illustrates first and second interlocking planar jigsaw puzzle pieces 140, 142 similar to pieces commonly found in two-dimensional jigsaw puzzles. Each piece 140, 142 includes sidewalls 148 that are substantially perpendicular to a plane defined by the upper surface of the respective puzzle piece. The pieces 140, 142 are shown partially engaged, with a cove 144 of piece 140 engaging a tab 146 of piece 142. The pieces 140, 142 may be brought into full engagement by translating the piece 140 downward such that the respective sidewalls 148 slide against each other until both pieces are coplanar. It will be recognized that in order to avoid damage, the pieces 140, 142 must remain in substantially parallel planes during assembly and disassembly and are engaged by translating one piece relative to the other along a line parallel to the sidewalls 140.

If the pieces are moved substantially out of parallel planes with respect to each other, binding will occur between the sidewalls 148 of the respective pieces, 140, 142, especially around the engagement area of the cove 144 and tab 142, and damage will ensue. The amount of binding, and consequent damage, is directly related to the thickness of the puzzle pieces relative to their size.

Non-planar puzzle pieces are even more susceptible to binding, since no two puzzle pieces can be positioned coplanar to each other, and movement of a piece that avoids binding with one adjacent piece may cause binding with a piece that is adjacent on the opposite side.

Figure 13:
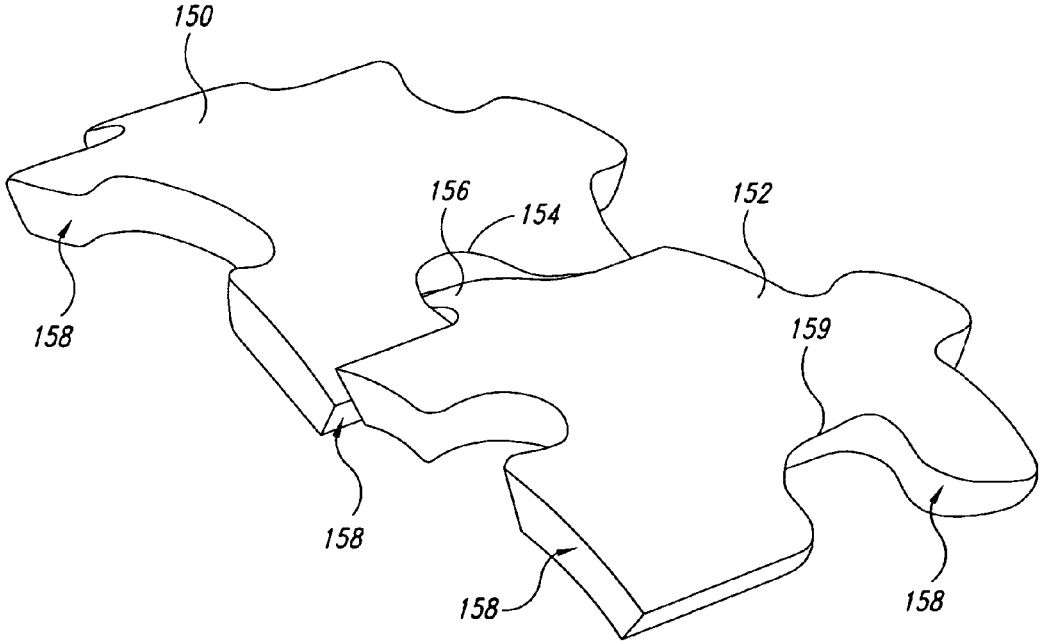
FIG. 13 shows two interlocking puzzle pieces according to an embodiment of the invention.

FIG. 13 illustrates first and second non-planar jigsaw puzzle pieces 150, 152 according to an embodiment of the invention. Each piece 150, 152 includes sidewalls 158 that are beveled inward as described with reference to FIGS. 11A and 11B. The pieces 150, 152 are shown partially engaged, with a cove 154 of piece 150 engaging a tab 156 of the piece 152. The pieces 150, 152 may be brought into full engagement by rotating the piece 152 downward relative to piece 150 until the upper surfaces of the pieces lie along a common arc.

Because the sidewalls 158 are beveled, the pieces 150, 152 make contact only at the top edges of the sidewalls, and no binding or damage occurs, even around the interlocking engagement of the tab 156 and the cove 154. Furthermore, as the pieces 150, 152 are rotated into full engagement, in can be seen that cove 159 can be brought into full engagement with a tab of another piece without binding. The position of the piece 152 relative to the piece 150, as shown in FIG. 13, may be a common transitional position between non-planar pieces as a puzzle is assembled or disassembled.

Figure 14:
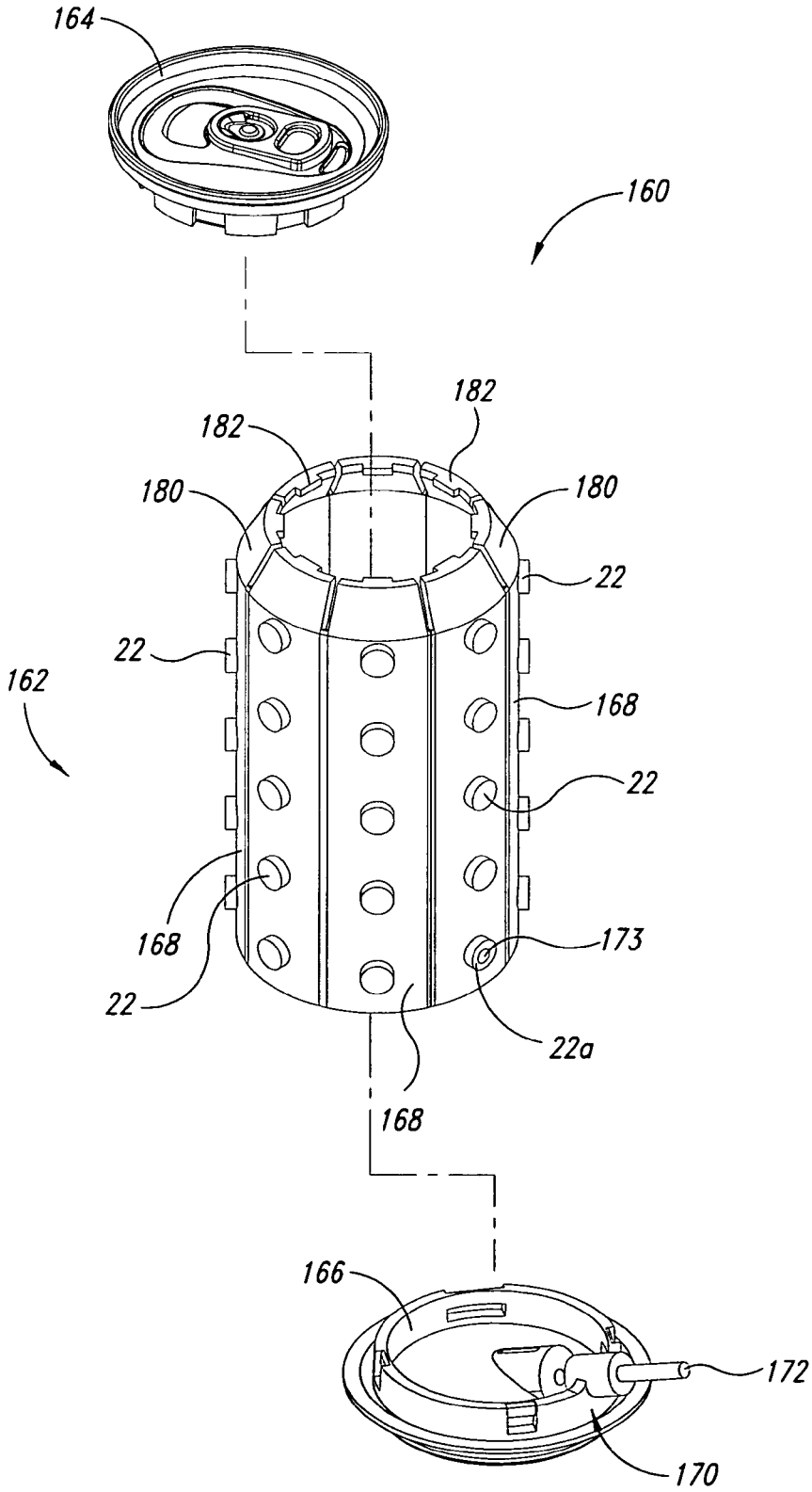
FIG. 14 is a partially exploded view of a puzzle in the form of a soda can, according to an embodiment of the invention.
Figure 15A:
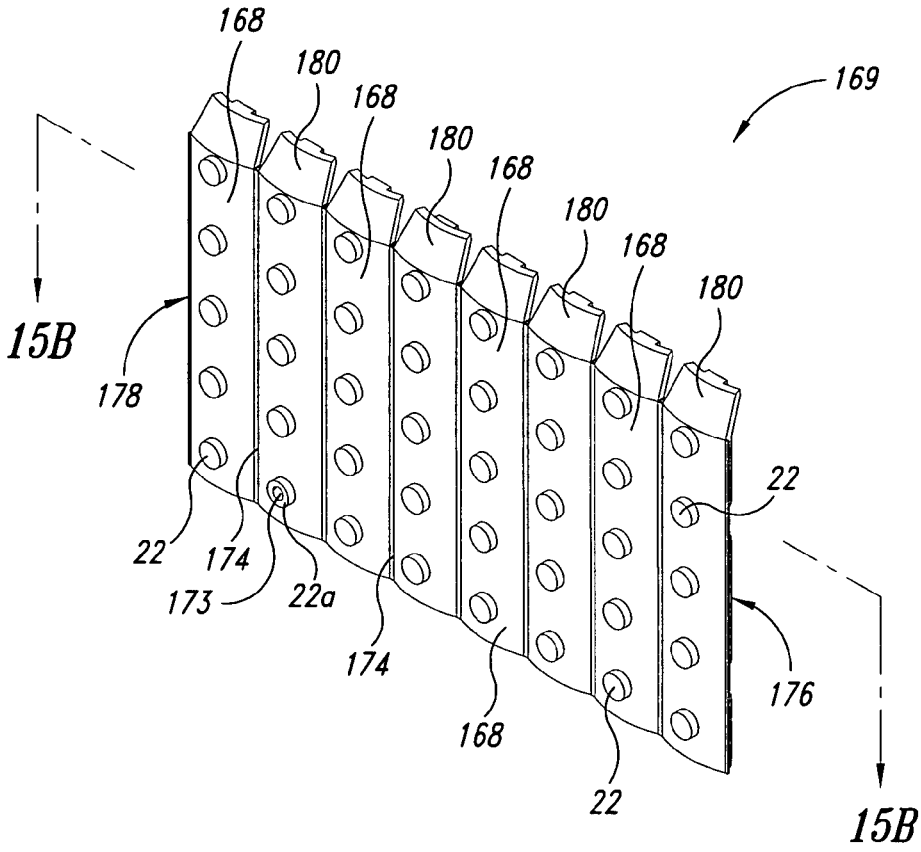
FIGS. 15A and 15B show details of a substrate of the puzzle of FIG. 14, with FIG. 15B being a cross section taken along the lines 15B-15B of FIG. 15A.
Figure 15B:
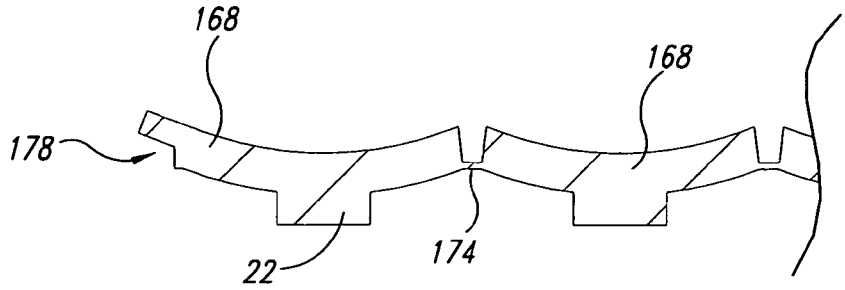

Turning now to FIGS. 14-15B, features of a puzzle 160 are shown. FIG. 14 shows a partially exploded view of a soda can puzzle 14, and in particular the substrate 162 of the puzzle, configured to receive puzzle pieces (not shown) as described with reference to previous embodiments, and in particular, with reference to the embodiments of FIGS. 5 and 6. The puzzle 160 includes a substrate 162 having a generally cylindrical shape and comprising a plurality of semicylindrical segments 168, the segments 168 together forming a central portion of the substrate 162 of the soda can puzzle 160. Each segment 168 includes a top rim portion 180 that, together with the top rim portions 180 of the other segments 168, angles inward to form a tapered rim region of the cylindrical substrate 162 corresponding to a feature commonly incorporated into the design of many soda cans.

The substrate 162 also includes a top segment 164 contoured and shaped to resemble the top of a typical soda can, and a bottom segment 166, likewise shaped and contoured to resemble the bottom of a typical soda can. The segments 168 include tabs 182 configured to cooperate with the top segment 164 to permit the segment 164 to couple to the plurality of segments 168. The coupling of the top segment 164 to the plurality of tabs 168 may be a snap-fit coupling, a press-fit coupling, or some other configuration. In a similar manner, the bottom segment 166 is configured to engage features (not shown) of the plurality of segments 168 to allow the bottom segment 166 to couple to the plurality of segments 168.

The bottom segment 166 includes a release mechanism 170. The release mechanism 170 is configured to align with a protrusion 22*a* such that release pin 172 passes through an opening 173 in the protrusion 22*a* at a first end and extends through an opening (not shown) in an exterior surface of the bottom segment 166 at a second end (not shown) thereof. By pressing upward against the second end of the release pin 172, a user can drive the release pin through the opening 173 of the protrusion 22*a* to drive a puzzle piece off the protrusion 22*a*. In this way, a first puzzle piece can be removed from the substrate of the puzzle 160. A user can then continue removing puzzle pieces from the substrate by lifting up with a finger or fingernail against the edges of puzzle pieces exposed by the removal of previous puzzle pieces, as described in more detail with reference to previous embodiments.

FIG. 15A shows the plurality of semicylindrical segments 168 as they appear prior to assembly. The plurality of segments is formed as a single segment unit 169 of injection molded plastic, with each segment 168 having a sufficient thickness so that the respective segment is rendered substantially rigid. The segments 168 are joined by thin membranes 174 having a reduced thickness so that the membranes 174 are flexible enough to permit the segment unit 169 to roll into a cylindrical shape. Structures such as the membranes 174 are sometimes referred to in the industry as living hinges. This is visible in more detail in FIG. 15B.

During assembly, the segment unit 169 is rolled into a cylindrical shape so that a first edge 176 engages a second edge 178 of the unit 169. According to one embodiment, the edges 176 and 178 are solvent welded together to form a substantially permanent bond. The top and bottom segments 164, 166 are then coupled to the cylindrical portion of the substrate 162, as previously described. The top and bottom segments 164, 166 may be solvent welded to the cylindrical portion. The substrate 162 is now in condition to receive puzzle pieces, as described with reference to previous embodiments.

Referring now to FIGS. 16A-16D, a puzzle 200 in the form of a baseball is shown according to another embodiment of the invention. The puzzle 200 is similar to the embodiment of the invention described with reference to FIG. 7 inasmuch as both embodiments are substantially spherical and formed to resemble in size and appearance a typical baseball. The puzzle 200 includes a substrate 202 having a plurality of protrusions 22 and is configured to receive thereon a plurality of puzzle pieces 204.

Figure 16A:
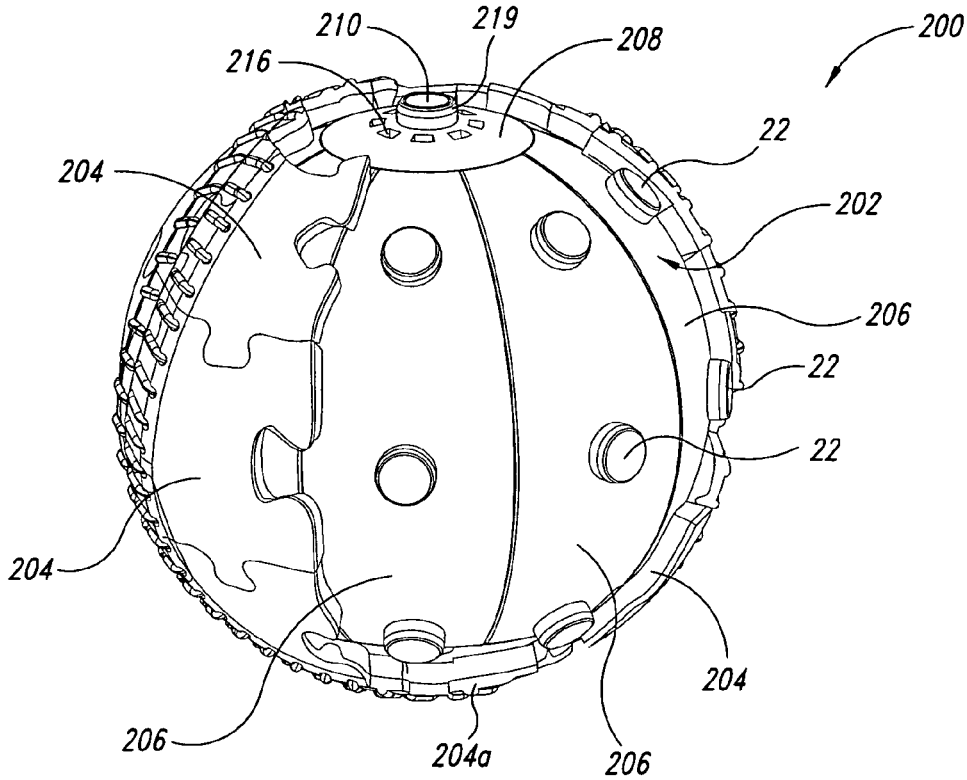
FIGS. 16A and 16B are two views and of a puzzle in the form of a baseball, according to another embodiment of the invention.
Figure 16B:
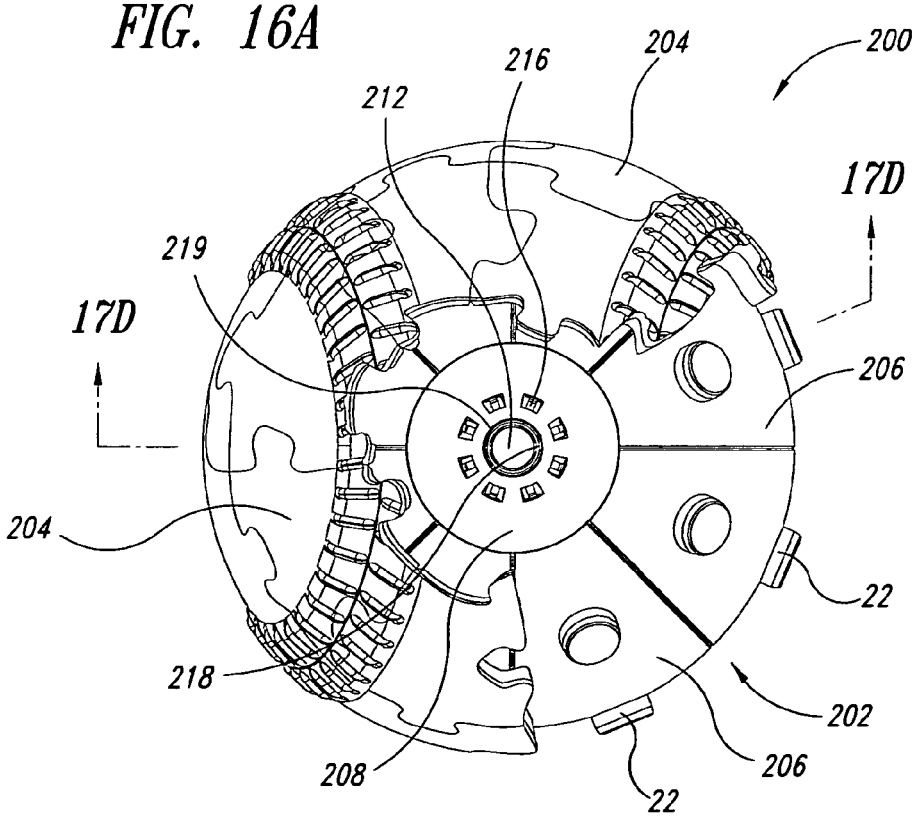

The substrate 202 comprises a plurality of segments 206 coupled together and distributed radially around a central axis of the puzzle 200, each segment 206 comprising a wedge-shaped portion of the spherical puzzle. Top and bottom segments 208, 210 are positioned at what can be termed pole regions of the spherical puzzle 200 and are configured to couple the segments 206 together as will be described hereafter. FIG. 16B shows a top view of the puzzle 200. The top segment 208 may be seen clearly, including a plurality of apertures 216. A release pin 212 extends into an aperture 218 formed in the center of the top segment 208.

Figure 16D:
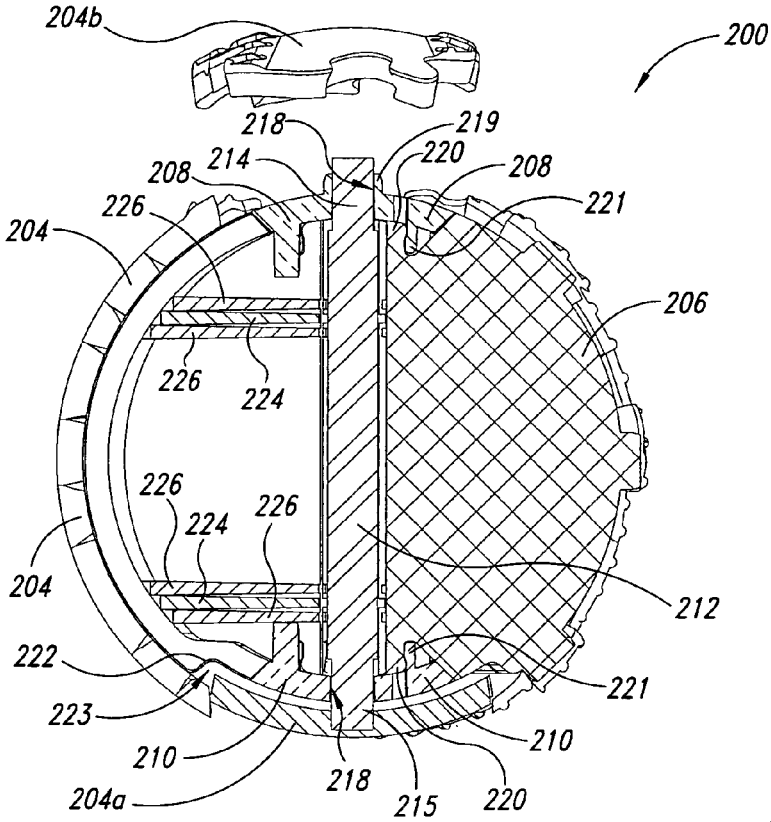
FIG. 16D is a cross section of the puzzle of FIG. 16B, taken along the lines 16D-16D.
Figure 16C:
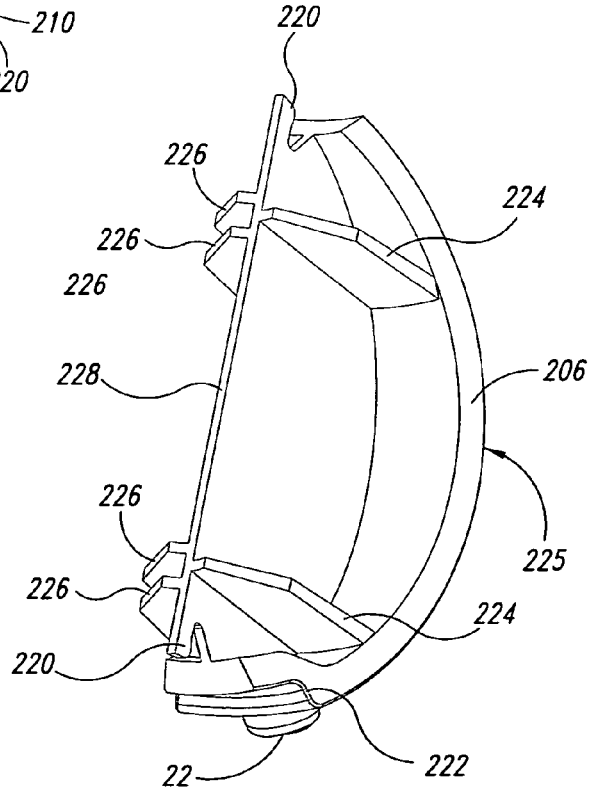
FIG. 16C shows a segment of a substrate of the puzzle of FIGS. 16A and 16B.

FIG. 16C shows one segment 206 of the puzzle 200. The wedge-shaped segment 206 of the puzzle 200 includes a plurality of protrusions 22 in an outer surface 225, a central spine 228, locking tabs 220, male coupling tabs 224, and female coupling tabs 226. A lower portion of the segment 206 includes a release indent 222.

FIG. 16D shows a cross section of the puzzle 200, taken along the lines 16D-16D of FIG. 16B. The cross sectional view of FIG. 16D is not a planar section, but includes a break at the central axis in order to show the cooperation of the coupling tabs 224, 226 on the left, and to show the cooperation of the locking tabs 220 of the segments 206 with locking flanges 221 of the top and bottom segments 208, 210 on the right, as detailed hereafter.

In the embodiment pictured in FIGS. 16A-16D, the puzzle 200 includes eight substantially identical segments 206. When the segments 206 are assembled to form the substrate 202 of the puzzle 200, pairs of female coupling tabs 226 of each of the segments 206 engage individual male coupling tabs 224 of an adjacent segment. When all the segments 206 are interconnected, the locking tabs 220 of the respective segments project upward and downward, and are evenly spaced around the central axis of the puzzle 200. The top and bottom segments 208, 210 may then be placed over the locking tabs 220 of the segments 206 such that each locking tab 220 engages a locking flange 221 of the top or bottom segment 208, 210. In this way, each of the segments 206 is captured between the top and bottom segments 208, 210, as well as by engagement with the coupling tabs 224, 226 of adjacent segments 206.

The various segments 206, 208, 210, of the substrate 202 may be configured to interconnect with snap-fit engagement, interference fit, or simply by slideable engagement. The substrate 202 may be disassemblable by a user, in which case the segments thereof may be considered to be additional puzzle pieces. Alternatively, the segments 206, 208, 210 of the substrate may be configured to permanently lock together or may be otherwise permanently assembled, such as by adhesive or solvent welding, so that the substrate 202 becomes effectively a single piece upon which a user assembles the puzzle 200.

Referring to FIG. 16D, the release pin 212 is shown extending axially from a top portion to a bottom portion of the puzzle 200. In the embodiment pictured, the release pin 212 includes narrowed end regions 214 configured to pass into apertures 218 of the top and bottom segments 208, 210. During assembly, the release pin 212 is placed in position prior to placement of the top and the bottom segments 208, 210. When the top and bottom segments 208, 210 are coupled to the plurality of segments 206, the release pin 212 is captured between the segments 208, 210 such that it is free to move back and forth along the center axis of the puzzle 200 for a short distance.

Release indents 222 of each of the segments 206 collectively form a depressed region 223 of the substrate 202. It may be seen, referring to FIG. 16D, that the second end 215 of the release pin 212 engages a depression formed in the puzzle piece 204*a*. The puzzle piece 204*a* is positioned over the depressed region 223 such that it does not make contact with the substrate 202 of the puzzle 200. Accordingly, the only contact between the substrate 202 and the puzzle piece 204*a* is via the release pin 212. When the puzzle 200 is fully assembled, the puzzle piece 204*a* is positioned such that an outer surface thereof is in alignment with and co-spherical with the outer surfaces of the other puzzle pieces 204.

Because of the depressed region 223 and the travel permitted by the first and second narrowed ends 214, 215 of the release pin 212, the puzzle piece 204*a* can be moved with the release pin 212 axially toward the substrate 202, as shown in FIG. 16D. Such movement causes the first end 214 of the release pin 212 to extend from the aperture 218 of the top segment 208. The aperture 218 is centered within a protrusion 219 positioned on the top segment 208 and centered on the central axis of the puzzle. A puzzle piece 204*b*, coupled to the protrusion 219 in a typical fashion, is ejected from the substrate by the first end 214 of the release pin 212 when the puzzle piece 204*a* is translated toward the substrate 206. Once the first puzzle piece 204*b* is removed from the substrate, it is a simple matter for a user to remove succeeding puzzle pieces from the substrate as described in the previous embodiments. According to some embodiments, the puzzle piece 204*a* is permanently affixed to the second end 215 of the release pin 212 that this piece is not removable from the substrate 202.

Figure 17:
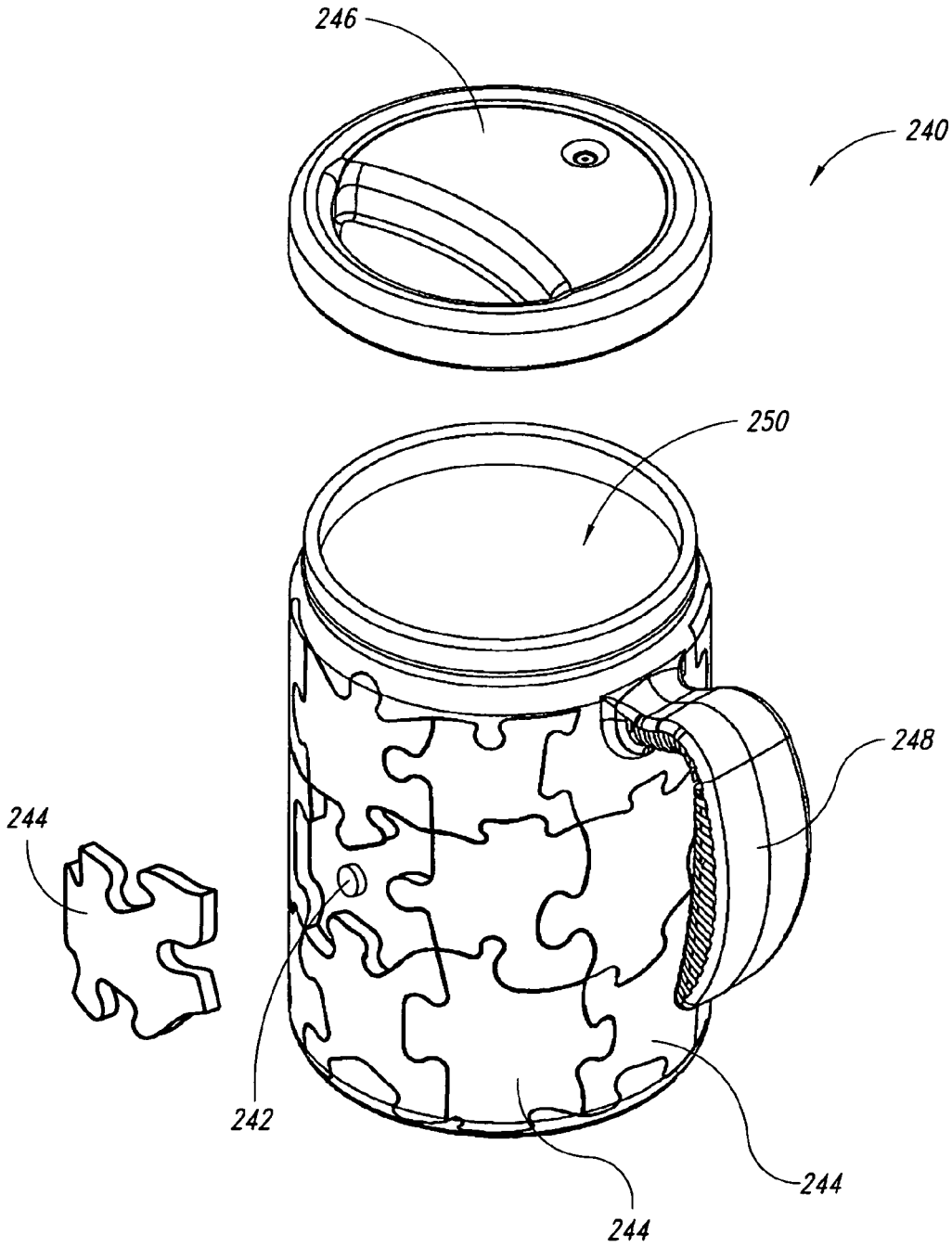
FIG. 17 is a puzzle in the form of a beverage container, according to an embodiment of the invention.

FIG. 17 shows a puzzle 240 in the shape of beverage container in accordance with another embodiment of the invention. The puzzle 240 includes a substrate 242, a plurality of puzzle pieces 244, and a lid 246. The substrate 242 includes a handle 248 and a cavity 250 suitable for receiving a beverage therein. The lid 246 is configured to be coupled to the substrate 242 with a snap or interference fit such that the cavity 250 can be substantially sealed by the lid. The lid 246 may include features configured to facilitate drinking of a beverage by a user while the lid 246 is in place over the cavity 250. For example, the lid 246 may include a closable aperture for passage of the beverage, a vent aperture to permit entrance of air into the cavity 250, and other features typically found in beverage container lids.

The puzzle pieces 244 are configured to interlock with each other and to be removably coupled to the substrate 242. Some or all of the pieces 244 may also be provided with surface markings thereon, such as a company logo, an amusing phrase, a graphical image, etc. A user may employ the puzzle 240 as a beverage container, as a challenging assembly exercise, or as a marketing piece to be distributed for the purpose of creating publicity based on the surface markings.

Terms such as upper, upward, lower, and downward are used in this specification to refer to the pictured embodiments as they are oriented in the figures, and are intended only as an aid in understanding the various embodiments. Where used in the claims, terms referring to upper or to faces of puzzle pieces refer to the surface intended to be viewed by a user when the corresponding puzzle is fully assembled, i.e., the outermost surface of a three-dimensional puzzle. This is also the surface that is decorated with colors, logos, images, etc., when such decoration is employed. By the same token, terms referring to lower or bottom faces refer to faces opposite the upper or top faces.

Puzzle pieces of various embodiments of the invention may be configured to engage features of the respective substrates with an interference fit such that some force is required to move a piece into full engagement with the substrate. In addition, or alternatively, the individual pieces of a puzzle may be sized such that there is interference between adjacent pieces when assembled, to reduce a likelihood that the pieces will fall off the substrate. This will again result in a degree of force being required to attach a piece to the substrate between previously attached pieces.

While various embodiments of the invention have been illustrated and described, it is to be understood that changes may be made therein without departing from the spirit and scope of the invention. For example, a single puzzle piece may be permanently attached to the support structure to provide a starting point for assembly of the puzzle. More than one release mechanism may be incorporated into a single puzzle to facilitate removal of the puzzle pieces from the substrate. Features described with reference to one embodiment may be combined with those of another embodiment, including methods of manufacture and means for release of the pieces from the structural supports. Furthermore puzzles having the shape and appearance of other familiar objects also fall within the scope of the invention. From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

The invention claimed is:

1. A three dimensional puzzle, comprising:

a plurality of non-planar interlocking puzzle pieces, each of the plurality of puzzle pieces having:

a feature configured to engage a corresponding feature of at least one other of the plurality of puzzle pieces, when correctly co-positioned therewith;

an upper surface;

a lower surface; and an edge defining a perimeter of the piece, the edge configured such that, when the piece is correctly co-positioned in all dimensions, relative to all of the plurality of puzzle pieces that are adjacent to the puzzle piece, the puzzle piece makes contact along its entire perimeter with contiguous portions of the adjacent puzzle pieces at their respective upper surfaces without making contact at their respective lower surfaces.

2. The puzzle of claim 1 wherein the edge comprises a bevel angled inward from the upper surface toward the lower surface.

3. The puzzle of claim 1, further comprising a puzzle substrate, and wherein each of the plurality of interlocking puzzle pieces includes a coupling feature configured to interconnect with a corresponding coupling feature of the puzzle substrate.

4. The puzzle of claim 3 wherein the coupling feature of each of the plurality of interlocking puzzle pieces is configured to engage the corresponding coupling feature in an interference fit.

5. The puzzle of claim 3 wherein each of the plurality of interlocking puzzle pieces is sized to engage adjacent puzzle pieces in an interference fit.

6. The puzzle of claim 3 wherein the coupling feature of each of the plurality of interlocking puzzle pieces is unitary with the respective piece.

7. The puzzle of claim 3 wherein the respective coupling feature on the puzzle substrate corresponding to each of the plurality of interlocking puzzle pieces is unitary with the substrate.

8. The puzzle of claim 3 wherein the coupling feature of each of the plurality of interlocking puzzle pieces has a thickness that is less than a mode thickness of the respective puzzle piece.

9. The puzzle of claim 1 wherein, when fully assembled, the puzzle is in a form selected from among a soda can, a baseball, a beverage container, a piece of fruit, and a vehicle.

10. The puzzle of claim 1, comprising:

a plurality of semi-cylindrical sub-segments configured to be coupled together radially around an axis to form a substantially cylindrical segment;

a first end segment having a shape substantially similar to a top portion of a soda can and configured to be coupled to a first end of the cylindrical segment; and a second end segment having a shape substantially similar to a bottom portion of a soda can and configured to be coupled to a second end of the cylindrical segment, the cylindrical segment, the first end segment, and the second end segment together forming a puzzle substrate, the plurality of puzzle pieces configured to be removably coupled to the substrate and to interlock with each other to complete a likeness of a soda can.

11. The puzzle of claim 10 wherein each of the plurality of puzzle pieces is non-planar.

12. The puzzle of claim 10 wherein the shape of the edge of each of the plurality of puzzle pieces includes a bevel.

13. The puzzle of claim 10 wherein the outer surface of each of the plurality of puzzle pieces includes markings such that, when assembled on the puzzle substrate, the puzzle resembles the soda can in color and marking.

14. The puzzle of claim 10 wherein the plurality of semi-cylindrical sub-segments are formed as a single component having hinge regions formed between adjacent sub-segments such that the component may be rolled into the substantially cylindrical shape, the hinge regions comprising thinned regions of material.

15. The puzzle of claim 10, further comprising a release mechanism configured to facilitate decoupling of one of the puzzle pieces from the puzzle substrate.

16. The puzzle of claim 15 wherein the release mechanism comprises a release pin slideably coupled to the substrate such that biasing pressure against a first end thereof will cause the release pin to apply decoupling pressure to one of the plurality of puzzle pieces.

17. A puzzle in the shape of a baseball, the puzzle comprising:

a plurality of semi-spherical sub-segments configured to be positioned radially around an axis to form a substantially spherical segment having first and second ends lying on the axis;

a first semi-spherical end segment configured to be coupled to the plurality of semi-spherical sub-segments at the first end of the spherical segment and including a first plurality of engaging elements, each positioned and configured to engage a first end of a respective one of the plurality of semi-spherical sub-segments; and a second semi-spherical end segment configured to be coupled to the plurality of semi-spherical sub-segments at the second end of the spherical segment and including a second plurality of engaging elements, each positioned and configured to engage a second end of a respective one of the plurality of semi-spherical sub-segments, the first end segment and the second end segment together configured to lock each of the plurality of semi-spherical sub-segments together and to form therewith a substantially spherical puzzle substrate.

18. The puzzle of claim 17, further comprising a plurality of non-planar puzzle pieces configured to be removably coupled to the puzzle substrate and to interlock with each other to complete a likeness of the baseball.

19. The puzzle of claim 18, further comprising a release pin having first and second ends and configured to traverse the puzzle substrate, the first end of the release pin adapted to extend through an aperture in the first end segment and separate one of the plurality of puzzle pieces from the substrate when the release pin is moved toward its first end.

20. The puzzle of claim 19, further comprising a key puzzle piece configured to be permanently coupled to the second end of the release pin such that biasing pressure against an outer surface of the key puzzle piece tends to cause the release pin to move axially toward its first end.

21. The puzzle of claim 20 wherein the substantially spherical substrate includes a depressed region positioned and sized to admit the key puzzle piece.

* * * * *